United States Patent [19]

Hatfield

[11] 4,328,965

[45] May 11, 1982

[54] PORTABLE ARCHERY MUSCLE DEVELOPER

[76] Inventor: Raymond C. Hatfield, 1999 Lancaster La., Wheaton, Ill. 60187

[21] Appl. No.: 159,638

[22] Filed: Jun. 16, 1980

[51] Int. Cl.[3] ..... A63B 21/02

[52] U.S. Cl. ..... 272/137; 272/140; 272/143; 272/142; 124/23 R

[58] Field of Search ..... 272/137, 142, 143, 140, 272/135; 124/1, 23 R

[56] References Cited

U.S. PATENT DOCUMENTS

| | | | |
|---|---|---|---|
| 766,743 | 8/1904 | Terry | 272/140 |
| 885,074 | 4/1908 | Nideuer | 272/140 |
| 4,174,832 | 11/1979 | Thompson | 272/140 X |

*Primary Examiner*—Richard C. Pinkham
*Assistant Examiner*—William R. Browne
*Attorney, Agent, or Firm*—Neuman, Williams, Anderson & Olson

[57] ABSTRACT

A compact, portable archery exerciser allows an archer to accurately emulate the pulling of a bow to tone and strengthen the muscles used in archery. A first embodiment of the exerciser comprises two elongated handle members which are interconnected at the ends by a selectable number of resilient members to provide an exerciser with a selectable pull weight. A second embodiment of the exerciser includes a housing having an internal chamber and a handle portion for receiving an archer's bow holding hand. A spring loaded pulley is mounted within the chamber and receives a cable which, when unwound from the pulley, compresses the spring. The cable is routed outside the chamber where it is attached to a handle which is positioned to allow an operator of the exerciser to pull the handle away from the handle portion of the housing to accurately simulate the pulling of a bow. An adjustable pulley mounted within the chamber engages the cable to allow adjustment of the pull weight of the second embodiment of the exerciser.

7 Claims, 8 Drawing Figures

PORTABLE ARCHERY MUSCLE DEVELOPER

BACKGROUND OF THE INVENTION

This invention relates to exercise apparatus and more particularly, to portable exercise apparatus for developing the muscles used in archery.

Archery is a sport which requires strength and good muscle tone for consistent accuracy in propelling an arrow to a desired target. The ideal way to maintain muscle tone for archery is, of course, to regularly practice by shooting at an archery range. However, such regular practice is often impossible due to such things as proximity to an archery range, inclement weather conditions, time requirements, trips, etc.

Until now, an archer who is unable to practice on a regular basis could attempt to maintain muscle strength and tone by performing various exercises such as push ups, chin ups, isometric exercises, etc. Alternatively, the archer could use chest and upper body exercise devices which are not designed to be held and drawn in a manner similar to the holding and drawing of a bow. Accordingly, an archer utilizing such techniques does not attain the benefit of having fully exercised the archery muscles which are required for his chosen sport.

It is possible for an archer to regularly exercise with a bow. This form of exercise requires removing the bow from its place of storage, stringing the bow, repeatedly pulling the bow string, unstringing the bow and returning it to its place of storage. Certainly, such exercise can adequately prepare an archer for the sport; however, it also can prematurely age and lead to early failure of the bow and bow string. Additionally, the use of a bow in the home is awkward and can lead to damage of walls, ceilings, furniture, lamps, etc. To add to these disadvantages, a bow is not readily portable and exercise is limited to the place of storage of the bow for all practical purposes.

Specialized archery exercisers are available. Such exercisers include weights, ropes, stands and pulleys to simulate the holding of a bow and pulling of its bow string. These prior art archery exercisers generally involve raising and lowering the weights to exercise the archery muscles. All these prior art exercisers suffer from disadvantages similar to those noted above with reference to the use of a bow, i.e., they are bulky, unwieldy, heavy, difficult to transport and require dedicated space or considerable time to set up the exerciser before it can be used.

It is an object of the present invention to provide a compact, portable archery exerciser which overcomes the disadvantages of the presently available exercise alternatives when one cannot regularly practice the sport of archery.

It is another object of the present invention to provide a compact, portable exerciser for strengthening all of the muscles which an archer uses in the acts of holding a bow and pulling the bow string from its released position to the archer's full draw length.

It is yet another object of the present invention to provide a portable, compact archery exerciser which can conveniently be taken to the archer's place of employment, on trips, etc. to enable the archer to regularly exercise the muscles used in archery. Regular exercise strengthens and tones the archery muscles so that the archer is able to draw and then hold the bow more steadily at full draw for longer periods of time. Such steady execution of the archery movements improves aiming, releasing and follow through which are necessary skills in the successful pursuit of archery.

It is an additional object of the present invention to provide a compact, portable archery exerciser in which the pull force is adjustable to allow the archer to build up the strength of the muscles required for archery to, for example, progress to a more powerful bow.

It is yet an additional object of the present invention to provide a compact, portable archery exerciser which provides a constant pull weight throughout the entire range of draw of the archer.

It is still another object of the present invention to provide a portable, compact archery exerciser which will produce a pull weight which increases to a maximum at approximately mid pull and decreases beyond mid pull to simulate pulling the bow string of a variety of bows commonly referred to as compound bows.

SUMMARY OF THE INVENTION

These objects are achieved by a compact, portable archery exerciser which comprises first handle means for receiving the bow holding hand of an archer, second handle means grasped by the string pulling hand of the archer and connecting means for resiliently connecting the first handle means to the second handle means whereby the archer can exercise his archery muscles by extending the first handle means to the position normally occupied by a bow and by pulling the second handle means in the manner of a bow string.

In a first embodiment of the archery exerciser of the present invention, the first and second handle means comprise elongated handle members. The connecting means comprises at least one resilient member interconnecting a first end of the first handle to a first end of the second handle and at least one resilient member similarly connecting the second end of the first handle to the second end of the second handle. The formation of the handles and the connection of the resilient members to the ends of the handles provide adequate clearance for the wrist and forearm of the operator of the exercise apparatus and allow the operator to accurately simulate the pull of a bow to correctly exercise the archery muscles of the operator.

The resilient members of the first embodiment of the archery exerciser are expansion springs, rubber bands or other resilient bands or expansion members. An operator can selectively connect one or more resilient members to each end of the handles to produce the amount of pull resistance desired by that operator. Resilient members having differing resistance to expansion can also be used to vary the pull resistance of the first embodiment of the exerciser.

In accordance with a second embodiment of the present invention, the first handle means comprises a housing having an interior chamber and a handle portion extending from that chamber. The handle portion is formed to resemble the hand hold of a bow and comfortably conform to a human hand. The connecting means comprises a spring loaded pulley which is mounted within the chamber of the housing and cable means wrapped around the pulley such that when the cable is unwound from the pulley the spring loading the pulley is compressed. The cable is routed to an aperture in the housing and extends through that aperture to where it is connected to the second handle means which is normally held against the housing by the action of the spring loaded pulley. The pulling of a bow is simulated by holding the handle portion of the housing in the bow holding hand of an operator and extending that portion as one would extend a bow. The operator of the exerciser then grasps the second handle resting against the housing and pulls that handle as one would pull the bow string of a bow.

The pull weight of the second embodiment of the archery exerciser is adjustable by means of a pulley or roller which is adjustably mounted within the housing. The cable loops about the adjustable pulley and controls the compression or bias of the spring loading the spring loaded pulley. If the adjustable pulley is moved away from the spring loaded pulley, a section of cable is unwound from the latter pulley to increase the bias of the spring loading it and thereby increase the pull weight of the exerciser. Conversely, if the adjustable pulley is moved toward the spring loaded pulley, a section of cable is wound onto the pulley to decrease the bias of the spring and thereby decrease the pull weight of the exerciser.

The spring loaded pulley can have a conically advancing groove in which the cable means rides to provide a constant pull weight over the entire draw length of the exerciser. Alternatively, a spirally advancing groove can be provided on the spring loaded pulley with one circumferential turn of the groove being eccentrically offset from the other turns to provide a pull resistance which peaks at the approximate mid point of the pull length of the exerciser. This mid point pull weight peak simulates the pull characteristics of bows which are commonly referred to as compound bows.

Other objects and advantages of the invention will become apparent upon reading the following detailed description and the appended claims with reference to the accompanying drawing.

BRIEF DESCRIPTION OF THE DRAWING

For a more complete understanding of this invention, reference should now be made to the embodiments illustrated in greater detail in the accompanying drawing figures and described below by way of examples of the invention. In the drawing.

Figure 1:
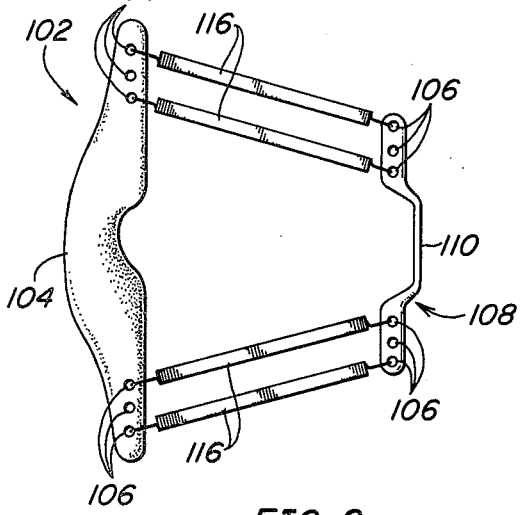
FIG. 1 is a side elevation of a first embodiment of a compact, portable archery exerciser in accordance with the present invention.

It should be understood that the drawing figures are not necessarily to scale and that certain details which are not necessary for an understanding of the present invention or would render other details difficult to understand may have been omitted. Of course it should also be understood that the invention is not limited to the particular embodiments illustrated herein.

DETAILED DESCRIPTION OF ILLUSTRATIVE EMBODIMENTS

With reference to FIG. 1, a first embodiment of an archery exerciser in accordance with the present invention is shown. A first elongated member 102 incorporates a formed handle 104 located near the mid portion of the member 102. The handle 104 is shaped to resemble the hand hold of a bow and to accordingly comfortably conform to an archer's bow holding hand. The elongated member 102 includes mounting holes 106 positioned at the extremities of the member.

A second elongated member 108 similarly includes mounting holes 106 positioned at its extremities. The elongated member 108 is formed to accommodate the string pulling fingers of an archer and hence is relatively narrow throughout its mid section 110. The second elongated member 108 is shown as being slightly shorter than the first member 102; however, the relative dimensions of the two members are not critical to the present invention.

Figure 1A:
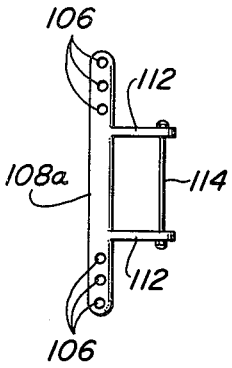
FIG. 1A is a side elevation of an alternative second handle for the embodiment of FIG. 1.

An alternate embodiment of the second elongated member **108*a* is shown in FIG. 1A. The elongated member 108*a* similarly includes mounting holes 106 near its extremities and incorporates two extensions 112 which are designed to receive a portion of bow string 114 to accurately reproduce the feel of pulling an actual bow when utilizing the archery exerciser. The provision of the portion of bow string 114** also allows the archer operating the exerciser to use a standard bow string release mechanism if such a device is normally used by the archer.

Resilient members 116 are connected between corresponding mounting holes 106 of the first elongated member 102 and the second elongated member 108 or **108*a*. The exerciser as illustrated in FIG. 1 incorporates two resilient members 116 at either end to interconnect the elongated members 102 and 108. Provision is made in the embodiment there illustrated for up to three members to be mounted at each end to provide for selective variation action of the pull resistance for the exerciser. It is noted that any reasonable number of resilient members could be provided between the two elongated members and that brackets, loops or other fastening devices could be used in place of the holes 106 in the elongated members. The resilient members 116** can be expansion springs, rubber bands, or other resilient bands or expansion members.

The resilient members 116 are of a sufficient length to provide pull resistance over a distance corresponding to the entire pull distance of a bow. Thus, the resilient members 116 are dimensioned such that when they are at their full relaxed length as shown in FIG. 1, the elongated member 102 and the elongated member 108 or **108*a*** are separated by approximately 8 to 12 inches. This spacing corresponds to the approximate brace height of a bow, i.e., the distance between the hand hold of the bow and the string when the bow is strung and in its rest position.

Figure 2:
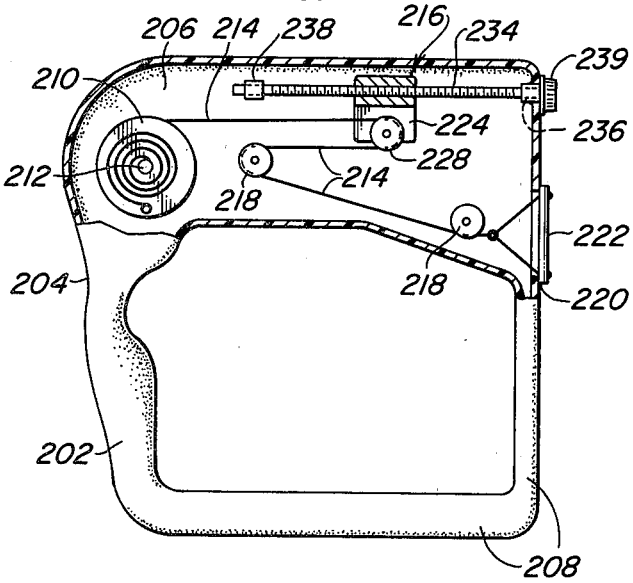
FIG. 2 is a partially cross-sectioned side elevation of a second embodiment in accordance with the invention.

A second embodiment of the archery exerciser in accordance with the present invention is shown in a partially cross-sectioned side view in FIG. 2. A first handle 202 which simulates the hand hold of a bow is integrally formed into a housing 204. The housing 204 can be formed from any material but must be light in weight and accordingly, is preferably formed from a high strength plastic, aluminum or other high strength, light weight metal or alloy. The housing 204 is dimensioned such that the separation between the handle 202 and the handle 222 approximates the brace height of a bow when the exerciser is at rest.

The housing 204 includes an upper chamber 206 for containing the operating mechanism of the exerciser. The bottom portion of the handle 202 is connected to the back portion of the chamber 206 of the housing 204 by an L-shaped section 208 to provide added strength for the housing 204. The handle portion 202 and the L-shaped section 208 can be either hollow or solid dependent upon the method of production, weight considerations, etc. It is also understood that the L-shaped connecting section 208 is not necessary and may not be provided at all in an exerciser in accordance with the present invention.

The chamber 206 of the housing 204 includes a spring loaded pulley 210 which is mounted on a shaft 212 extending between a front wall which has been removed for the sectional view of FIG. 2 and the back wall of the chamber 206. The spring loaded pulley 210 can have alternate configurations which will be described more fully hereinafter with reference to FIGS. 4, 5 and 7. A cable 214 is wrapped around the pulley 210 in a clockwise direction such that when the cable is unwound from the pulley 210 the pulley rotates in a clockwise direction and this rotation causes the spring of the spring loaded pulley 210 to become more compressed and resist the unwinding of the cable 214. The cable 214 can be a steel strand cable, a rope, or other flexible cord having sufficient strength and durability to endure extended operation of the exerciser.

The cable 214 is routed around the pull weight adjusting mechanism 216 and the two alignment pulleys 218 to an aperture 220 through the right-hand wall of the chamber 206 of the housing 204 as shown in FIG. 2. The alignment pulleys 218 are mounted in a manner similar to that of the spring loaded pulley 210, i.e., on individual shafts mounted between the front and back walls of the chamber 206. The alignment pulleys 218 promote smooth operation of the exerciser, extend cable life and facilitate the pull weight adjustment of the exerciser. Although the alignment pulleys are prepared, it is to be understood that the cable 214 could also be aligned by channels or protuberances formed within the chamber 206.

The cable is routed to the aperture 220 to provide the proper orientation between the handle 222 which is connected to the cable 214 and the handle portion 202 of the housing 204 such that a comfortable direct pull can be utilized by the operator of the exercise apparatus which pulling motion does not tend to rotate the handle 202 in the operator's hand. The aperture 220 is indicated as being large enough to accommodate the front portion of the handle 222 to provide a more compact unit. It is to be understood, however, that the handle 222 could just as well be provided entirely external of the housing 204 in which case the aperture 220 would only be large enough to accommodate the cable 214.

The pull weight adjusting mechanism 216 provides for effectively controlling the length of the cable 214 to select the bias of the spring loading the pulley 210 and thereby selectively vary the pull weight of the exerciser. It is noted that the pull weight adjusting mechanism 216 need not be provided for an archery exerciser in accordance with the present invention. However, it is convenient to provide varying pull weights, for example, to accommodate a number of archers, to allow an archer to increase his strength and correspondingly the pull weight of a bow which would be used, and to allow a gradual conditioning of the archery muscles after a prolonged period of inactivity.

Figure 3:
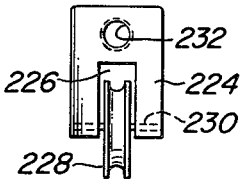
FIG. 3 is an end elevation of the pull weight adjusting element shown in FIGS. 2 and 6.

The pull weight adjusting mechanism 216 comprises weight adjusting block 224 which is shown in end elevation in FIG. 3. The adjusting block 224 has a channel 226 cut in the bottom portion thereof. A pulley 228 is mounted in the channel 226 on a shaft pin 230 which extends between and engages the two sides of the weight adjusting block 224 which define the channel 226. A threaded hole 232 is formed longitudinally through the adjusting block 224. A long bolt 234 passes through an aperture 236 of the chamber 206 and engages the threaded hole 232 of the weight adjusting block 224. The bolt 234 is supported and aligned by the bracket 238 which is formed inside the chamber 206 and includes an aperture therethrough to accommodate the bolt 234 for free rotation therein. The head 239 of the bolt 234 is positioned outside the housing 204 and can be ridged as shown for easy hand adjustment. Of course a standard fastener head could also be used, e.g., a slot head, phillips head, hex head, etc. to accommodate a suitable tool for rotating the bolt to thereby adjust the position of the weight adjusting block 224 relative to the spring loaded pulley 210.

By rotating the bolt 234 in one direction, the weight adjusting block 224 is moved closer to the pulley 210 thus reducing the bias on the spring loading the pulley 210 and the pull weight required to pull the handle 222 away from the handle portion 202. By turning the bolt 234 in the opposite direction, the weight adjusting block 224 is moved away from the pulley 210 thus increasing the bias on the spring and the pull weight required to operate the exerciser. Other arrangements for effectively shortening the cable length to adjust the pull weight will be apparent to those skilled in the art in view of the teaching herein. Other well known arrangements for prebiasing or adjusting the bias of the spring which loads the pulley 210 can be utilized in the exerciser of the present invention.

Figure 4:
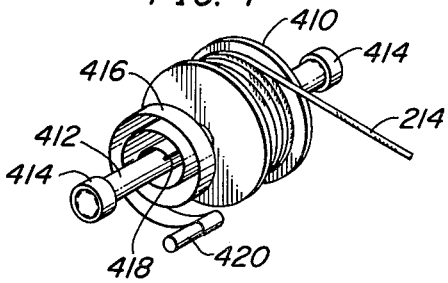
FIG. 4 is a pictorial view of one embodiment of a spring loaded pulley which provides the pull resistance in the embodiments shown in FIGS. 2 and 6.

FIG. 4 shows one possible construction of the spring loaded pulley 210. A pulley 410 is mounted to a shaft 412 which extends between bearings 414 which are mounted in the front and back walls of the chamber 206 as indicated by the pulley 210 in FIG. 2. The pulley 410 is firmly affixed to the shaft 412 so that when the pulley 410 is rotated by winding or unwinding the cable 214, the shaft 412 also rotates in the bearings 414. A coil spring 416 encircles the shaft 412 and has one end inserted into a slot 418 or is otherwise firmly affixed to the shaft 412. The other end of the spring 416 is firmly affixed to the housing 204 by the pin 420 or other means. As shown in FIG. 4, when the cable 214 is unwound from the pulley 410, the pulley 410 and the shaft 412 rotates in a clockwise direction which compresses the string 416. Conversely when the force on the cable 214 is reduced, the cable 214 is wound onto the pulley 410 in response to the action of the spring 416.

Figure 5:
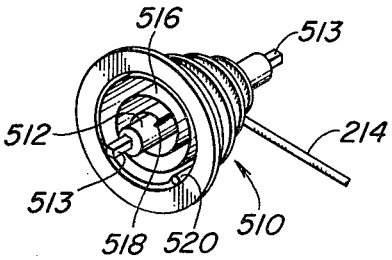
FIG. 5 is a pictorial view of a spring loaded spiral conical pulley which can be used to provide a constant pull weight for the exerciser.

FIG. 5 shows another possible configuration of the spring loaded pulley 210 wherein the pulley 510 is a spiral pulley having a conically advancing groove. This allows a constant force to unwind the cable 214 from the spiral pulley 510. In the configuration shown in FIG. 5, the spiral pulley 510 is not firmly affixed to the shaft 512 but has a bearing engagement for rotation thereon. The shaft 512 is firmly mounted within the chamber 206 of the housing 204 by means of the squared shaft ends 513. The spiral pulley 510 is open at the wide end thereof such that a coil spring 516 can be mounted at least partially within the pulley 510 to reduce the lateral dimension of the combination of the spring loaded pulley. The spring 516 is firmly affixed to the pulley 510 at 520 and the other end of the spring 516 is firmly affixed to the shaft 512 via insertion into a slot 518 or by other means. When the cable 214 is unwound from the spiral pulley 510, the spring 516 resists that motion and is placed in tighter and tighter compression. The spiral pulley 510 allows a constant force to unwind the cable 214 due to the increasing lever arm created by the conically advancing groove of the spiral pulley 510.

Figure 6:
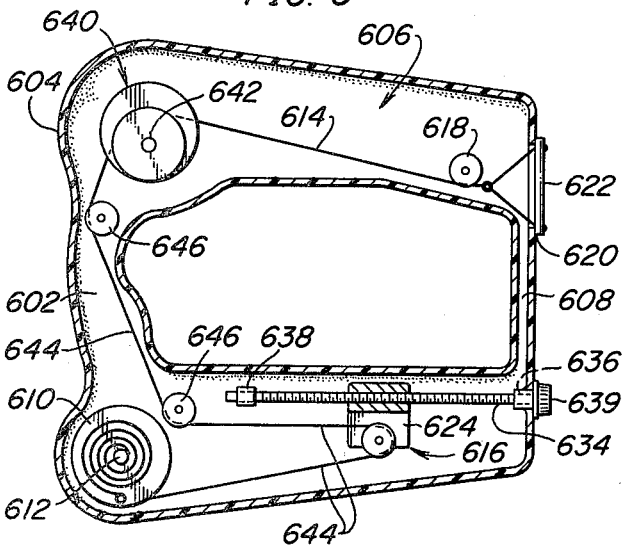
FIG. 6 is a cross-sectioned side elevation of an alternate embodiment of the exerciser of FIG. 2 incorporating an eccentric pulley to simulate the pull characteristics of a compound bow.

FIG. 6 shows an alternate embodiment of the archery exerciser of FIG. 2 wherein the pull weight increases to a maximum at approximately mid pull and decreases thereafter as is characteristic of bows commonly referred to as compound bows. FIG. 6 has been numbered such that corresponding elements of FIG. 2 and FIG. 6 are similarly numbered but in the two hundred and six hundred series of numbers respectively. The handle portion 602 of the housing 604 is formed generally the same as the handle portion 202 of FIG. 2. Also the housing 604 is dimensioned similar to the housing 204, however, the entire housing 604 is hollow to form a chamber 606. The working apparatus of the exerciser is mounted in a U-shaped section of the chamber 606 which extends through the handle portion 602. The spring loaded pulley 610 mounted on the shaft 612 is of the fixed shaft variety as shown in FIG. 5 although for this embodiment, it does not use a conical pulley as shown therein. The spring loaded pulley 610 and the weight adjusting assembly 616 are mounted in the lower portion of the chamber 606 in this embodiment of the exerciser.

Figure 7:
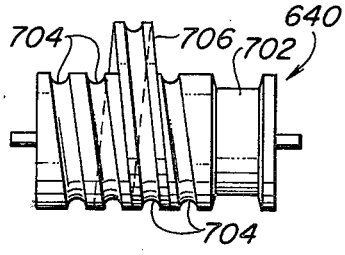
FIG. 7 is an eccentric pulley for use in the embodiment of FIG. 6.

A dual pulley 640 mounted on the shaft 642 extending between the front and back sides of the chamber 606 of the housing 604 is shown in detail in FIG. 7. The groove 702 of the pulley 640 receives the cable 614 which is attached to the handle 622 and is unwound from the groove 702 as the handle 622 is pulled away from the handle portion 602 during operation of the exerciser. The spirally advancing groove 704 receives the cable 644 which is routed to the spring loaded pulley 610 via the alignment pulleys 646 and the pull weight adjusting mechanism 616. The cable 644 is connected to the right end of the spiraling groove 704 of the pulley 640 as shown in FIG. 7 so that it is wound onto that groove as the cable 614 is unwound from the groove 702 of the combination pulley 640. The pull weight adjusting mechanism 616 comprises the pull weight adjusting block 624, the bolt 634 which extends through the aperture 636 and terminates in the head 639 and the bracket 638 and operates as previously described with reference to the pull weight adjusting assembly 216 of FIG. 2.

The operation of the archery exerciser of FIG. 6 is as follows. As the handle 622 is pulled away from the housing 604, the cable 614 extends outside the housing as it is unwound from the groove 702 of the combination pulley 640. As the combination pulley 640 is thereby rotated, it takes up the cable 644 in the spiraling groove 704 of the combination pulley 640. As the cable 644 is wound around the large eccentric turn 706 of the combination pulley 640 which occurs at approximately the mid length of the full length pull of the pull handle 622, the pull force is maximized due to the offset of the large eccentric turn 706. As the cable advances beyond the eccentric turn 706, the pull weight is again reduced, thus the operation of the exerciser as shown in FIG. 6 simulates the pull characteristics of a compound bow.

From the above description, it is apparent that the objects of the present invention have been achieved. While only certain embodiments have been set forth, alternative embodiments and various modifications will be apparent from the above description to those skilled in the art. For example, alternative ways of effectively shortening the cable to adjust the pull weight of the exerciser or direct adjustment of the spring loading the pulley are possible. Also, a variety of spirally grooved pulleys having varying eccentric turns of the groove are possible to simulate various pull characteristics and these alternate pulleys can be used with either direct spring loading as shown in FIG. 2 or indirect spring loading as shown in FIG. 6. These and other alternatives are considered equivalents and within the spirit and scope of the present invention.

What is claimed is:

1. An archery exerciser comprising:

first handle means for receiving the forward, bow holding hand of an archer at a position extended at arm's length from said archer, said first handle means comprising a housing including a central aperture defining a formed handle portion, said aperture being sized and shaped to provide adequate clearance for an operator's wrist and forearm during utilization of the exerciser;

second handle means for receiving the string pulling hand of said archer;

connecting means for resiliently connecting said first handle means to said second handle means, said connecting means mounted within said housing and comprising: a spring loaded pulley, cable means wrapped around said pulley in a direction to increase the loading when said cable means is unwound from said pulley, alignment means for routing said cable means from said pulley through the sidewall of said housing, and means for securing said cable means to said second handle means; and spring control means for adjustably controlling the state of compression of said spring loaded pulley to vary the pull resistance of said exerciser, said spring control means comprising adjustable means mounted within said housing and engaging said cable means whereby said archer can simulate the action of pulling a bow by pulling said second handle means away from said first handle means.

2. The exerciser of claim 1 wherein said adjustable means comprises:

a generally rectangular block having a longitudinal channel formed along one side and a threaded aperture extending the entire length of the block;

rotational means for engaging said cable means mounted for free rotation within said channel;

shaft means having threads sized to engage said threaded aperture in said block, said shaft means extending through the sidewall of said housing and including adjustment means for rotating said shaft means, said adjustment means being positioned outside said housing; and means for positioning and retaining said shaft means within said housing.

3. The exerciser of claim 2 wherein said rotational means comprises a pulley.

4. The exerciser of claim 2 wherein said shaft means comprises a bolt.

5. An archery exerciser comprising:

a housing including an interior chamber and an aperture open to said chamber, said housing including a handle portion shaped to comfortably accommodate a human hand;

a shaft mounted within said chamber;

a pulley mounted on said shaft and including a cable receiving groove;

a pull handle;

cable means attached to said pulley and engaging the groove of said pulley;

spring means engaging said shaft for resisting the rotation of said pulley in a direction to unwind said cable means from said pulley;

means for routing said cable means to said aperture and for adjusting the compression of said spring means, said cable means extending to and passing through said aperture, said routing and spring adjustment means comprising rotational means mounted within said chamber, the position of said rotational means being adjustable relative to said pulley and said rotational means engaging said cable means whereby the compression of said spring means is controlled by the position of said rotational means relative to said pulley; and means for connecting said cable means to said pull handle.

6. The archery exerciser of claim 5 wherein said pulley comprises a cone shaped groove whereby a constant pull resistance is encountered as said cable means is unwound from said pulley.

7. The archery exerciser of claim 5 wherein said pulley comprises a spirally advancing groove and at least one of the spirals of said groove are eccentrically offset whereby the pull resistance peaks when approximately half of the cable means has been unwound from said pulley and reduces when unwound beyond that point.

* * * * *